United States Patent [19]

Walker et al.

[11] Patent Number: 4,478,207

[45] Date of Patent: Oct. 23, 1984

[54] FURNACE

[76] Inventors: Lewis Walker, 3080 Sixth St. South; Thomas A. Taylor, 8794 W. KL Ave., both of Kalamazoo, Mich. 49009

[21] Appl. No.: 388,250

[22] Filed: Jun. 14, 1982

[51] Int. Cl.[3] ..... F24D 9/00

[52] U.S. Cl. ..... 126/101; 122/44 A; 122/379; 126/104 R; 165/95

[58] Field of Search ..... 126/101, 104 R, 104 A; 122/379, 380, 390, 44 R, 44 A, 51, 52, 110, 79, 80, 81; 165/95

[56] References Cited

U.S. PATENT DOCUMENTS

| | | | |
|---|---|---|---|
| 6,595 | 7/1849 | Chapman | 122/379 |
| 118,030 | 8/1871 | Lovegrove | 122/379 |
| 394,852 | 12/1888 | Gray | 122/79 |
| 724,646 | 4/1903 | Yeoman | 126/101 |
| 1,668,577 | 5/1928 | Vecchio | 122/44 A |
| 1,707,812 | 4/1929 | Lynch | 122/44 A |
| 2,149,696 | 3/1938 | Holmes | 122/44 A |
| 2,189,749 | 2/1940 | Windheim et al. | 126/101 |
| 2,369,972 | 2/1945 | Meagher | 126/101 |
| 2,573,004 | 10/1951 | Frank | 126/101 |
| 2,979,050 | 4/1961 | Costello | 126/104 R |

*Primary Examiner*—Daniel J. O'Connor
*Attorney, Agent, or Firm*—Gordon W. Hueschen

[57] ABSTRACT

The disclosure is directed to a furnace having an elongate, cylindrical, combustion chamber surrounded by a water jacket. Air is blown into the combustion chamber through a loop-shaped distributor having a front bight and a rear bight and parallel horizontal side members. Axially-oriented jet ports are disposed in said bights which direct jets of air toward each other into the center portion of the combustion chamber and chord-oriented jet ports in the side members which direct jets of air downwardly toward the bottom center of the combustion chamber. Fire-tubes are located in the top portion of the water jacket through which the combustion products flow in heat exchange with the water introduced into the water jacket and second fire-tubes in heat exchange with the outlet water lead the combustion gases to a stack. A special band of scraper-deflectors is provided on at least some of the fire-tubes.

4 Claims, 8 Drawing Figures

Fig. 1.
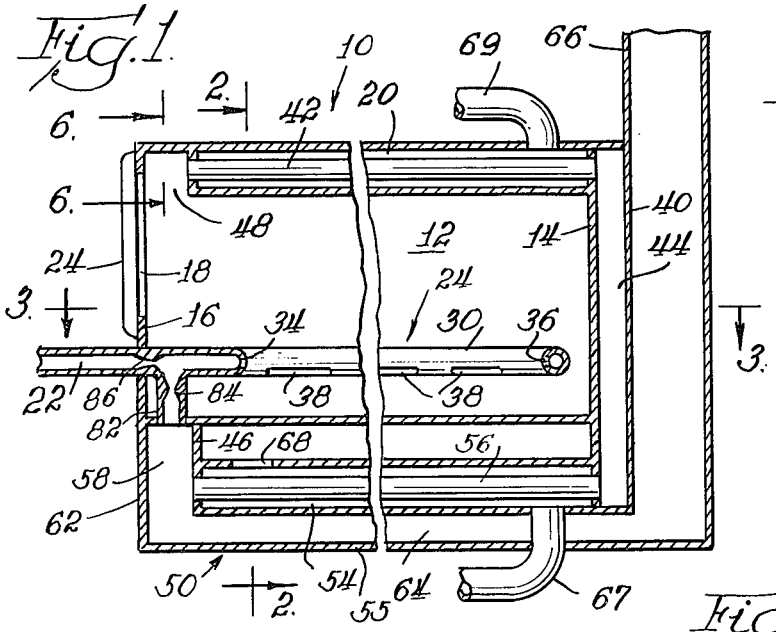
Fig. 2.
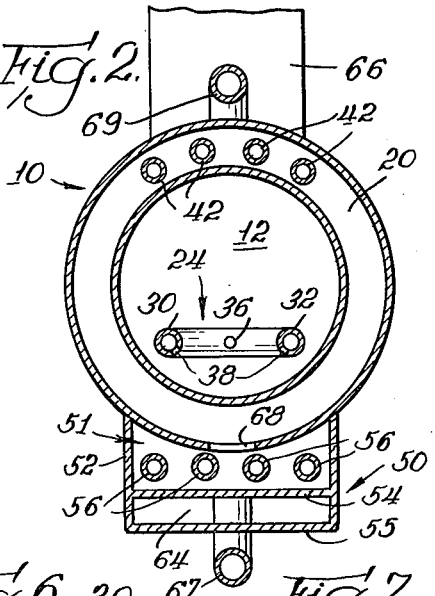
Fig. 3.
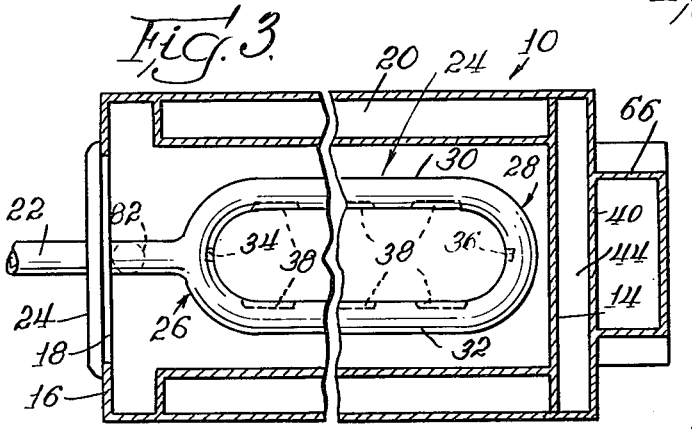
Fig. 6.
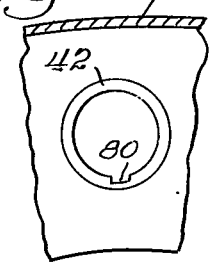
Fig. 7.
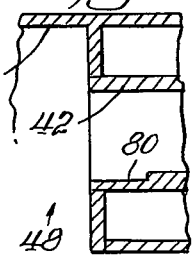
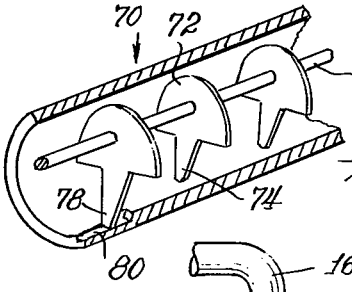
Fig. 8.
Fig. 4.
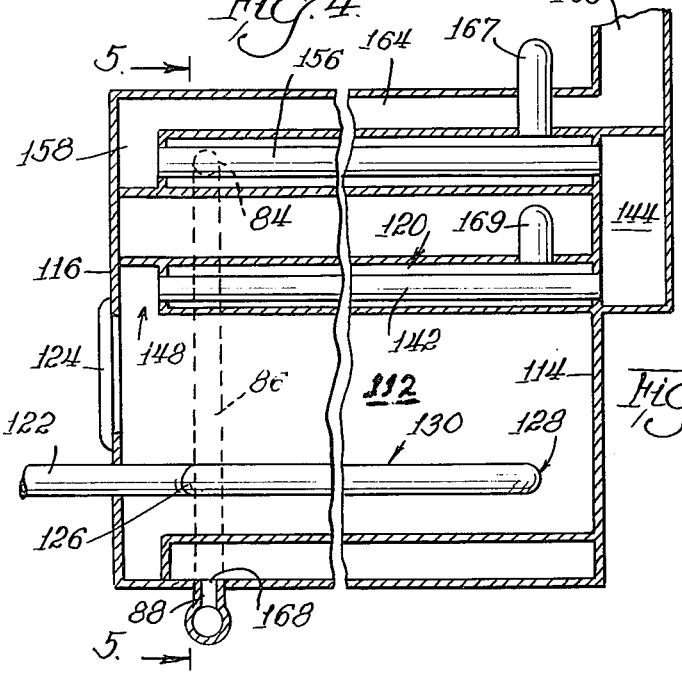
Fig. 5.
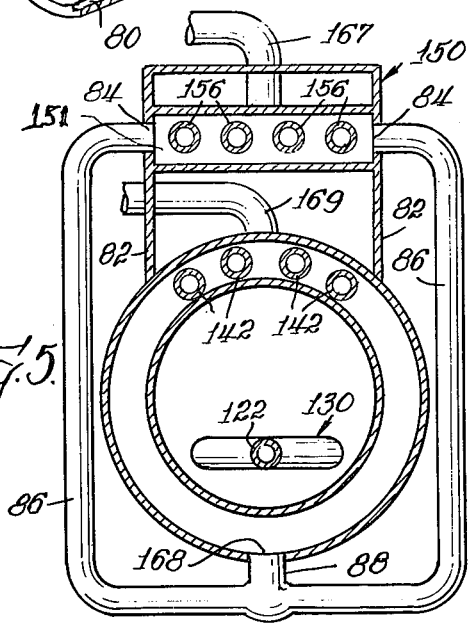

FURNACE

BACKGROUND OF THE INVENTION

Field of Invention and Prior Art

This invention relates to a furnace particularly adapted for burning wood and like fuel and is particularly directed to such furnaces in which the fire chamber is surrounded by a water jacket.

Furnaces of the class described are well known in the art. See, for example. U.S. Pat. No. 4,127,107. However, the furnaces heretofore available have been inefficient and have not been well adapted for general purpose heating. Thus, the furnaces heretofore available have largely been used as auxiliary heating units to supplement already existing other types of furnaces.

OBJECTS OF THE INVENTION

It is an object of the invention, therefore, to avoid the disadvantages of the prior art and to provide a new and efficient hot water furnace capable of burning wood and like fuel and capable of being used as a primary heating furnace. Other objects will become apparent as the description proceeds.

SUMMARY OF THE INVENTION

In one of its aspects, the invention is directed to a hot water furnace comprising an elongate, tubular, horizontally-disposed combustion chamber; an elongate, tubular water jacket surrounding said combustion chamber in heat exchange relation thereto; water inlet and outlet means; a firing door at the front end of said combustion chamber and a stack at the other end thereof; first heat exchange means comprising axially-disposed fire-tubes in heat exchange relation with said outlet means; second heat exchange means comprising axially-disposed second fire-tubes disposed in heat exchange relation with said inlet means; directing means for directing a flow of combustion gases from said combustion chamber through said first and second fire-tubes in succession; and conduit means in heat exchange relation with said inlet means for conducting the combustion gases effluent from said second fire-tubes to said stack.

This aspect of the invention also comprises one or more further features in which said first fire-tubes are located within the confines of said water jacket and said second fire-tubes and said conduit means are located exteriorly of said water jacket, in which said combustion chamber is provided with blower means for creating a forced draft therein, which comprises axially-oriented jet ports for directing jets of oxygen-containing gas axially into said combustion chamber from the front and rear ends thereof and toward the center thereof, and chord-oriented jet ports for directing oxygen-containing gas downwardly toward the bottom center of said combustion chamber, in which said combustion chamber is provided with blower means for creating a forced draft therein, said blower means comprising a loop-shaped conduit having front and rear bights and elongate, horizontally-disposed side members, said bights having jet ports therein to direct jets of oxygen-containing gas axially into said combustion chamber from the front and rear ends thereof, and said side members having jet ports therein oriented to direct oxygen-containing gas downwardly toward the bottom center of said combustion chamber, in which at least one of said fire-tubes is provided with a multiplicity of parallel scraper-deflectors having enlarged upper portions portions and narrow bottom portions, said scraper-deflector plates being mounted in bank on a common draw rod at an angle, with the enlarged upper portions being closer to one end of the fire tube in which the bank is inserted than the narrow bottom portions, in which at least one of said scraper-deflectors has detent means thereon complementary with detent means in the tube in which a bank of scraper-deflectors is inserted, which function to hold said bank against rotation therein, said plates being mounted on said draw rod at an angle, with the enlarged upper portions being closer to one end of the draw rod than the narrow bottom portions.

In another of its aspects, the invention is directed to a furnace comprising an elongate, cylindrical, horizontally-disposed combustion chamber in combination with blower means for creating a forced draft therein, which comprises axially-oriented jet ports for directing jets of oxygen-containing gas axially into said combustion chamber from the front and rear ends thereof and toward the center thereof and chord-oriented jet ports for directing oxygen-containing gas downwardly toward the bottom center of said combustion chamber. This aspect of the invention also comprises one or more further features in which said furnace is provided with a water jacket surrounding and in heat exchange with said combustion chamber, having first heat transfer means comprising axially-disposed fire-tubes in heat exchange relation with water outlet means, and second heat exchange means comprising second fire-tubes in heat exchange relation with water inlet means, and in which said furnace is further provided with directing means for directing a flow of combustion gases from said combustion chamber through said first and second fire-tubes in succession, in which said blower means comprises a loop-shaped conduit having front and rear bights and elongate, horizontally-disposed side members, said bights having jet ports therein oriented to form said axial jets and said side members having ports therein to form said chord-oriented jets, wherein at least one fire-tube is provided with a multiplicity of parallel scraper-deflector plates mounted in bank on a draw rod and having enlarged upper portions shaped to scrape the interior walls of said fire-tube when the bank of plates is pulled to and fro by said draw rod, said plates being mounted on said draw rod at an angle, with the enlarged upper portions being closer to one end of said draw rod than the narrow bottom portions, in which said fire-tube and at least one of said plates has complementary detent means which functions to prevent rotation of said plates in said fire-tube at least when the bank of plates is fully inserted into said fire-tube.

The invention further is directed, as a subcombination, to a scraper-deflector means for a fire-tube which comprises a multiplicity of parallel scraper-deflector plates mounted in bank on a draw rod and having enlarged upper portions shaped to scrape the interior walls of said fire-tube when the bank of plates is pulled to and fro by said draw rod, said plates being mounted on said draw rod at an angle, with the enlarged upper portions being closer to one end of said draw rod than the narrow bottom portions, and in which at least one of said plates has detent means adapted to mesh with complementary detent means in said fire-tube which functions to prevent rotation of said plates relative to said fire-tube.

BRIEF DESCRIPTION OF THE DRAWINGS

In the drawings:

FIG. 1 is a side elevation in cross-section.

FIG. 2 is a cross-sectional view taken along line 2—2 of FIG. 1;

FIG. 3 is a cross-sectional view taken on line 3—3 of FIG. 1;

FIG. 4 is a side elevation in cross-section of a modified form;

FIG. 5 is a cross-sectional view taken on line 5—5 of FIG. 4;

FIG. 6 is an enlarged fragmentary view taken in cross-section on line 6—6 of FIG. 1;

FIG. 7 is a fragmentary view in cross-section taken on line 7—7 of FIG. 6; and

FIG. 8 is an isometric view of a scraper deflector bank in a stylized fire-tube.

DESCRIPTION OF THE PREFERRED EMBODIMENTS

Referring now particularly to FIGS. 1 through 5, there is shown a hot water furnace 10 according to the invention in which 12 is an elongate, tubular, horizontally-disposed fire chamber having a closed rear end 14 and a partially closed front end 16. The front end 16 has an opening 18 therein for feeding fuel to the fire chamber and a door 24 adapted tightly to close the opening 18. The fire chamber 12 is jacketed by a water jacket 20, as will be more particularly described hereinafter.

A forced draft is created in the firing chamber by a blower means, not shown, which is connected to the inlet tube 22 which passes through the wall 16. Shortly after passing through the wall 16, the inlet tube forks into the loop 24 having a front bight 26 and a rear bight 28 and side members 30 and 32. The front bight 26 has an axially-oriented jet port 34 for directing an axial jet of an oxygen-containing gas into the fire chamber. Similarly, the rear bight 28 has an axially-oriented jet port 36 for for directing an axially-oriented jet of the gas into the fire chamber. The side members 30 and 32 have chord-oriented jet ports 38 oriented to direct jets of the gas downwardly toward the center of the bottom of the fire chamber 12.

The rear wall 14 extends out radially to the outer wall of the water jacket 20 and encloses the rear end of the water jacket. The outer walls of the water jacket 20 extend rearwardly to a second rear wall 40 which is spaced from rear wall 14 and forms a manifold 44 for the purpose to be described.

The upper portion of the water jacket 20 has a multiplicity of fire-tubes 42 therein. The rear ends of these fire-tubes open into the manifold 44 and the front ends open into the fire chamber 12. The front end of the water jacket 20 is closed by an annular wall 46 spaced from the front end wall 16. Part of the upper front wall of the fire chamber 12 is cut away, as shown at 48, to provide access of fire gases to the fire-tubes 42.

The fire-tubes 42 can be supported in the annular wall 46 and the corresponding annular portion of the rear wall 14, or separate header plates can be utilized for maintaining the tubes in the desired position.

At the bottom of the water jacket is a separate compartment 50 which communicates with the water jacket proper through one or more openings 68 adjacent the front of the water jacket and with the return line through inlet means 67 adjacent the rear end of the compartment 50.

The separate compartment 50 has a water-tight compartment 51 therein formed by the side walls 52, the bottom wall 55 of the water jacket 20, and a transverse dividing wall 54 apposed to and parallel to the bottom wall 55 of the compartment 50. The compartment 51 has a multiplicity of fire-tubes 56 therein, which communicates with the manifold 44 and with the manifold 58 formed by the wall 60 of compartment 51 apposed to the end wall 62 of compartment 50. The channel 64 beneath the divider 54 communicates with manifold 58 and with the stack 66. Thus, the combustion products pass up to the front of the fire chamber, up into the first or upper bank of fire-tubes 42, down through the header 44, then across the bottom through the second bank of tubes 56 into the manifold 58, then back through the channel 64 and out into the stack 66. If desired, the channel 64 could be a third bank of fire-tubes. At the same time, the return water enters the inlet 67 and flows in heat exchange with the fire-tubes 56 and divider 54, up through opening 68, into the main water jacket 20, and then out the outlet 69, where it is led to a suitable heat exchanger, not shown, which may be comprised in a furnace, a water heater, a swimming pool, or the like, and thence returned to the inlet 67.

The temperature of the water is controlled by an Acrostat, not shown, which cuts the blower in and out as needed to provide more or less heat. The fire chamber 12 is closed by the door 24 tight enough so that, when the blower is not running, little, if any, oxygen-containing gas is supplied, so that the burning stops virtually instantaneously. Then, when the Acrostat dictates the need for more heat, the blower starts and combustion starts in again. The fact that the fire chamber is jacketed by water maintained at a relatively high temperature, say 170 to 180 degrees or so, keeps the coals warm and in condition for immediate ignition as soon as oxygen-containing gas is supplied.

A suitable water pump, not shown, is provided for circulating the water to and from the heat exchanger which pump, advantageously, is programmed as a function of the temperature desired as a result of the heat exchange. Thus, if the furnace is used to heat a home, a thermostat turns the pump on and off in accordance with the demand for more heat. A hot water heater can be programmed in a like manner but, if used in conjunction with house heating, it will be sufficient to include a solenoid valve in the hot water heater circuit which is turned off and on by the thermostat in the hot water heater.

It is to be understood that the manifold 44 does not need to extend all the way across the width of the furnace, but need only to be wide enough to accommodate the several banks of fire-tubes.

The fire-tubes, especially the uppermost bank, are advantageously provided with a bank of scraper-deflectors, as illustrated in FIG. 8. These scraper-deflectors comprise a multiplicity of plates 70, having enlarged upper portions 72 and narrow bottom portions 74. These plates are mounted on a draw rod 76 and are oriented thereon with the enlarged upper portions being closer to one end of the fire-tube than the narrow bottom portions. Advantageously, the narrow bottom portions slope into the flow of combustion gases in the fire-tube and the enlarged upper portions slope away from them. Thus, when the gasses pass through the fire tube, the plates 70 cause a turbulence in the tube which promotes heat exchange between the combustion gases and the water in the water jacket. At least one of the plates 70 is provided with a detent which is complementary with a complementary detent in the fire tube to hold the bank of plates against rotation. Advantageously, this comprises a detent 78 on the bottom of the narrow portion 74 adapted to fit in a slot 80 in the fire tube. It will be understood, however, that these detents can be on other portions of the plates, for example, on the enlarged portions, and that the male detent can be on the fire tube and the female detent on the plates.

The upper portions 72 of the plates 70 are cross-sectioned to fit snugly with the upper portion of the fire-tube so that, when the bank is reciprocated back and forth by the draw rod 76, any encrustations on the fire-tube can be scraped off. Once the detents 78 and 80 are disengaged, the bank can be rotated so that the scraping can effect all surfaces of the fire-tube.

If desired, a conduit 82 can be provided to recycle combustion gases from manifold 58 to the inlet tube 22. By providing a suitable venturi throat 84 in the conduit 82 or a like venturi throat in inlet tube 22, or both, combustion gases will be aspirated from the manifold 58 into the oxygen-containing gas passing in through inlet tube 22.

FIGS. 4 and 5 show a modified form of the invention in which the separate compartment 50 is located at the top of the furnace. In these figures, the parts corresponding to like parts in FIGS. 1, 2, and 3 are given the same reference numerals plus 100. In this modified form, the separate compartment 150 is mounted on the top of the water jacket 120 by suitable supports 82 and is connected thereto by manifold 144. The water in compartment 151 comes in through inlet tube 167 and exits through outlets 84. Outlets 84 are connected by pipes 86 to inlet pipe 88 which communicates with inlet aperture 168. Combustion gases for the combustion chamber 112 pass up into manifold 148, across the fire-tube 142 to manifold 144, back through fire-tube 156, back across through channel 164, and into stack 166.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. A furnace comprising:

an elongate, cylindrical, horizontally-disposed combustion chamber in combination with blower means for creating a forced draft therein, in which said furnace is provided with a water jacket surrounding and in heat exchange with said combustion chamber and has heat transfer means comprising a plurality of sets of axially-disposed fire-tubes in heat exchange relation with water, and in which said furnace is further provided with gas directing means for directing a flow of combustion gases from said combustion chamber through said sets of fire-tubes in succession, and with water directing means whereby cold water is introduced and relatively hot water is withdrawn after passing in heat exchange with said sets of fire-tubes, at least one set of said fire-tubes being within the confines of said water jacket.

2. A furnace of claim 1, in which one set of said fire-tubes is disposed within the upper portion of the water jacket and another set of said fire-tubes is disposed along the bottom exterior of said water jacket.

3. A furnace of claim 1, in which one set of said fire-tubes is inside the top of said water jacket and another set of said fire-tubes is outside the water jacket and above the top thereof.

4. A furnace of claim 1, which further comprises a multiplicity of parallel scraper-deflector plates mounted in bank on a draw rod and having enlarged upper portions shaped to scrape the interior wall of a fire-tube when the bank of plates is pulled to and fro by said draw rod, said plates being mounted on said draw rod at an angle, with the enlarged upper portions being closer to one end of said draw rod than the narrow bottom portions, and in which at least one of said plates has detent means adapted to mesh with complementary detent means in said fire-tube which functions to prevent rotation of said plates relative to said fire tube.

* * * * *